US011871778B2

(12) United States Patent
Taurino et al.

(10) Patent No.: US 11,871,778 B2
(45) Date of Patent: Jan. 16, 2024

(54) CARTRIDGE FOR AN AEROSOL-GENERATING SYSTEM COMPRISING AN ALKALOID SOURCE COMPRISING A LIQUID ALKALOID FORMULATION

(71) Applicant: Philip Morris Products S.A., Neuchatel (CH)

(72) Inventors: Irene Taurino, Neuchatel (CH); Ihar Nikolaevich Zinovik, Neuchatel (CH)

(73) Assignee: Philip Morris Products S.A., Neuchatell (CH)

( * ) Notice: Subject to any disclaimer, the term of this patent is extended or adjusted under 35 U.S.C. 154(b) by 583 days.

(21) Appl. No.: 17/254,532

(22) PCT Filed: Jun. 28, 2019

(86) PCT No.: PCT/EP2019/067496
§ 371 (c)(1),
(2) Date: Dec. 21, 2020

(87) PCT Pub. No.: WO2020/002693
PCT Pub. Date: Jan. 2, 2020

(65) Prior Publication Data

US 2021/0267275 A1 Sep. 2, 2021

(30) Foreign Application Priority Data

Jun. 28, 2018 (EP) ..... 18180589

(51) Int. Cl.
*A24B 15/167* (2020.01)
*A24F 40/30* (2020.01)
(Continued)

(52) U.S. Cl.
CPC ..... *A24B 15/167* (2016.11); *A24F 40/30* (2020.01); *A24F 40/42* (2020.01); *A24F 40/10* (2020.01)

(58) Field of Classification Search
CPC ..... A24B 15/167; A24B 15/243; A24B 15/30; A24F 40/30; A24F 40/42; A24F 40/10; A24F 40/46
See application file for complete search history.

(56) References Cited

U.S. PATENT DOCUMENTS

2018/0140001 A1 5/2018 Gabbay
2021/0137170 A1* 5/2021 Taurino ..... A24F 40/465
2023/0172264 A1* 6/2023 Tesfatsion ..... A24F 40/20 131/328

FOREIGN PATENT DOCUMENTS

CA 2985529 C * 4/2023 ..... A24B 15/167
JP 2017-533726 A 11/2017
(Continued)

OTHER PUBLICATIONS

International Search Report and Written Opinion dated Oct. 1, 2019 in PCT/EP2019/067496 filed on Jun. 28, 2019.
(Continued)

*Primary Examiner* — Shawntina T Fuqua
(74) *Attorney, Agent, or Firm* — Oblon, McClelland, Maier & Neustadt, L.L.P.

(57) ABSTRACT

A cartridge for an aerosol-generating system is provided, the cartridge including: a first compartment containing an alkaloid source, the alkaloid source including a liquid alkaloid formulation having a polyhydric alcohol content of at least about 10 percent by weight and an alkaloid content of at least about 10 percent by weight; and a second compartment containing an acid source. An aerosol-generating system is also provided, including: the cartridge; and an aerosol-generating device including a housing defining a device
(Continued)

Figure 1:
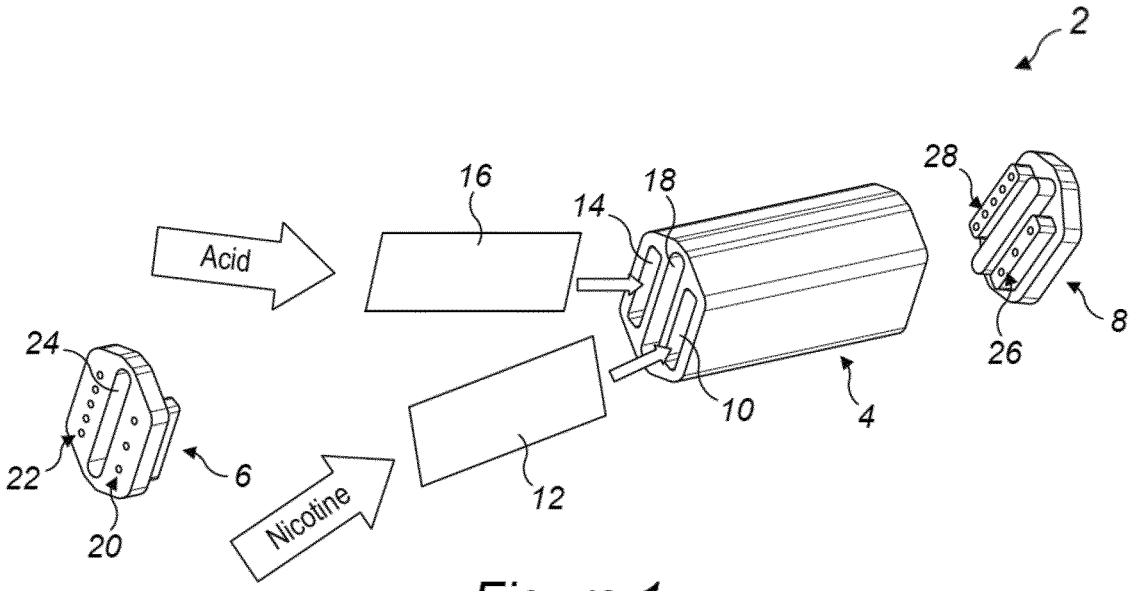

cavity configured to receive at least a portion of the cartridge, and a heating element configured to heat the first compartment and the second compartment of the cartridge.

15 Claims, 2 Drawing Sheets

(51) Int. Cl.
*A24F 40/42* (2020.01)
*A24F 40/10* (2020.01)

(56) References Cited

FOREIGN PATENT DOCUMENTS

| | | | | |
|---|---|---|---|---|
| JP | 2017-536816 | A | | 12/2017 |
| JP | 2017-538409 | A | | 12/2017 |
| JP | 2018-502586 | A | | 2/2018 |
| KR | 20190059269 | A | * | 5/2019 |
| RU | 2 336 001 | C2 | | 10/2008 |
| RU | 94 815 | U1 | | 6/2010 |
| RU | 95 226 | U1 | | 6/2010 |
| RU | 103 281 | U1 | | 4/2011 |
| WO | WO 2008/121610 | A1 | | 10/2008 |
| WO | WO 2016/046362 | A1 | | 3/2016 |
| WO | WO 2017/108991 | A1 | | 6/2017 |
| WO | WO 2013/099999 | A1 | | 6/2018 |

OTHER PUBLICATIONS

Extended European Search Report dated Dec. 7, 2018 in European Patent Application No. 18180589.6.

Brent Caldwell, et al., "A Systematic Review of Nicotine by Inhalation: Is There a Role for the Inhaled Route?", Nicotine & Tobacco Research, (2012), 1-13 pages.

Combined Russian Office Action and Search Report dated Oct. 17, 2022 in Russian Patent Application No. 2021101675 (with unedited computer generated English Translation), 17 pages.

Japanese Office Action dated Jul. 27, 2023 in Japanese Patent Application No. 2020-571827 (with English Translation), 11 pages.

* cited by examiner

CARTRIDGE FOR AN AEROSOL-GENERATING SYSTEM COMPRISING AN ALKALOID SOURCE COMPRISING A LIQUID ALKALOID FORMULATION

The invention relates to a cartridge for use in an aerosol-generating system and an aerosol-generating system comprising such a cartridge. In particular, the invention relates to a cartridge comprising an acid source and an alkaloid source comprising a liquid alkaloid formulation for use in an aerosol-generating system for the in situ generation of an aerosol and an aerosol-generating system comprising such a cartridge.

Devices for delivering nicotine to a user comprising a nicotine source and a volatile delivery enhancing compound source are known. For example, WO 2008/121610 A1 discloses devices in which nicotine and an acid, such as pyruvic acid, are reacted with one another in the gas phase to form an aerosol of nicotine salt particles that is inhaled by the user.

In devices of this type, the aerosol generated by the reaction of the nicotine and the acid can sometimes be perceived by the user as having a sensorial harshness when inhaled, which may adversely impact the user experience.

It would be desirable to provide a cartridge comprising a nicotine source and an acid source for use in an aerosol-generating system for the in situ generation of an aerosol that, in use, can provide an aerosol with improved perceived sensorial harshness.

It would be particularly desirable to provide a cartridge comprising a nicotine source and an acid source for use in an aerosol-generating system for the in situ generation of an aerosol that, in use, can provide an aerosol with improved perceived sensorial harshness without adversely impacting other properties of the aerosol, such as particle or droplet size and nicotine delivery.

According to the invention there is provided a cartridge for use in an aerosol-generating system, the cartridge comprising: a first compartment containing an alkaloid source; and a second compartment containing an acid source, wherein the alkaloid source comprises a liquid alkaloid formulation having a polyhydric alcohol content of at least about 10 percent by weight and an alkaloid content of at least about 10 percent by weight.

According to the invention there is further provided an aerosol-generating system comprising: a cartridge according to the invention; and an aerosol-generating device comprising: a housing defining a device cavity configured to receive at least a portion of the cartridge; and a heating element for heating the first compartment and the second compartment of the cartridge.

When used in an aerosol-generating system, the cartridge according to the invention advantageously allows the generation of an aerosol having an optimal particle or droplet size for inhalation that provides excellent nicotine delivery with improved perceived sensorial harshness.

As described further below, inclusion in the cartridge according to the invention of an alkaloid source comprising a liquid alkaloid formulation having a polyhydric alcohol content of at least 10 percent by weight and an alkaloid content of at least about 10 percent by weight has advantageously been found to reduce the perceived sensorial harshness of an aerosol generated by an aerosol-generating system comprising the cartridge compared to an aerosol generated by an aerosol-generating system comprising a cartridge comprising an alkaloid source comprising a liquid alkaloid formulation having an alkaloid content of at least about 10 percent by weight that does not comprise polyhydric alcohol. Without wishing to be bound by theory, this improvement in perceived sensorial harshness is believed to be due to coating or enveloping of alkaloid by polyhydric alcohol.

Furthermore, it has surprisingly been found that inclusion of at least 10 percent by weight polyhydric alcohol in the liquid alkaloid formulation of the alkaloid source of the cartridge according to the invention, does not significantly impact the particle or droplet size of an aerosol generated by an aerosol-generating system comprising the cartridge according to the invention. This is particularly important, since it enables the perceived sensorial harshness of the aerosol generated by an aerosol-generating system comprising the cartridge to be improved through inclusion of polyhydric alcohol without adversely impacting the delivery of aerosol by inhalation to a user.

It has also surprisingly been found that inclusion of at least about 10 percent by weight polyhydric alcohol in the liquid alkaloid formulation of the alkaloid source of the cartridge according to the invention can advantageously improve alkaloid delivery to a use by an aerosol-generating system comprising the cartridge according to the invention. In particular, it has been found that inclusion of at least about 10 percent by weight polyhydric alcohol in the liquid alkaloid formulation of the alkaloid source of the cartridge according to the invention, can enable a greater amount of alkaloid to be delivered per puff from a given quantity of alkaloid in the liquid alkaloid formulation of the alkaloid source.

As used herein with reference to the invention, the term "liquid alkaloid formulation" describes a liquid formulation comprising one or more alkaloids or a gel formulation comprising one or more alkaloids.

As used herein with reference to the invention, the term "gel formulation" may describe a substantially dilute cross-linked system, which exhibits no flow when in a steady state.

As used herein with reference to the invention, the terms "proximal", "distal", "upstream" and "downstream" describe the relative positions of components, or portions of components, of the cartridge and aerosol-generating system.

The aerosol-generating system according to the invention comprises a proximal end through which, in use, an aerosol exits the aerosol-generating system for delivery to a user. The proximal end may also be referred to as the mouth end. In use, a user draws on the proximal end of the aerosol-generating system in order to inhale an aerosol generated by the aerosol-generating system. The aerosol-generating system comprises a distal end opposed to the proximal end.

When a user draws on the proximal end of the aerosol-generating system, air is drawn into the aerosol-generating system, passes through the cartridge and exits the aerosol-generating system at the proximal end thereof. Components, or portions of components, of the aerosol-generating system may be described as being upstream or downstream of one another based on their relative positions between the proximal end and the distal end of the aerosol-generating system.

As used herein with reference to the invention, the term "longitudinal" is used to describe the direction between the proximal end and the opposed distal end of the cartridge or aerosol-generating system and the term "transverse" is used to describe the direction perpendicular to the longitudinal direction.

As used herein with reference to the invention, the term "length" is used to describe the maximum longitudinal dimension of components, or portions of components, of the cartridge or aerosol-generating system parallel to the longitudinal axis between the proximal end and the opposed distal end of the cartridge or aerosol-generating system.

As used herein with reference to the invention, the terms "height" and "width" are used to describe the maximum transverse dimensions of components, or portions of components, of the cartridge or aerosol-generating system perpendicular to the longitudinal axis of the cartridge or aerosol-generating system. Where the height and width of components, or portions of components, of the cartridge or aerosol-generating system are not the same, the term "width" is used to refer to the larger of the two transverse dimensions perpendicular to the longitudinal axis of the cartridge or aerosol-generating system.

The liquid alkaloid formulation may comprise one or more alkaloids.

The liquid alkaloid formulation may comprise one or more natural alkaloids.

The liquid alkaloid formulation may comprise one or more synthetic alkaloids.

Preferably, the liquid alkaloid formulation comprises one or more tobacco alkaloids.

As used herein with reference to the invention, the term "tobacco alkaloids" is used to describe alkaloids found in tobacco plants and tobacco smoke.

For example, the liquid alkaloid formulation may comprise one or more tobacco alkaloids selected from the group consisting of nicotine, nornicotine, nicotyrine, myosmine, cotinine, anabasine and anatabine.

The liquid alkaloid formulation may comprise one or more natural tobacco alkaloids.

The liquid alkaloid formulation may comprise one or more synthetic tobacco alkaloids.

Most preferably, the liquid alkaloid formulation comprises nicotine.

As used herein with reference to the invention, the term "nicotine" describes nicotine, nicotine base or a nicotine salt. In embodiments in which the liquid alkaloid formulation comprises a nicotine base or a nicotine salt, the amounts of nicotine recited herein are the amount of free base nicotine or amount of protonated nicotine, respectively.

The liquid alkaloid formulation may comprise natural nicotine or synthetic nicotine.

As used herein with reference to the invention, the term "liquid nicotine formulation" describes a liquid formulation comprising nicotine or a gel formulation comprising nicotine.

The liquid alkaloid formulation has a polyhydric alcohol content of at least about 10 percent by weight and an alkaloid content of at least about 10 percent by weight.

Unless stated otherwise, the percentages by weight of polyhydric alcohol and alkaloid in the liquid alkaloid formulation recited herein are based on the total weight of the liquid alkaloid formulation.

Preferably, the weight percent alkaloid content of the liquid alkaloid formulation is at least about 1.5 times the weight percent polyhydric alcohol content of the liquid alkaloid formulation. More preferably, the weight percent alkaloid content of the liquid alkaloid formulation is at least about 1.8 times the weight percent polyhydric alcohol content of the liquid alkaloid formulation. Most preferably, the weight percent alkaloid content of the liquid alkaloid formulation is at least about 2 times the weight percent polyhydric alcohol content of the liquid alkaloid formulation.

That is, preferably the ratio of the weight percent of alkaloid to the weight percent of polyhydric alcohol in the liquid alkaloid formulation is greater than or equal to about 1.5, more preferably greater than or equal to about 1.8, most preferably greater than or equal to about 2.

In embodiments in which the liquid alkaloid formulation is a liquid nicotine formulation, preferably the weight percent nicotine content of the liquid nicotine formulation is at least about 1.5 times the weight percent polyhydric alcohol content of the liquid nicotine formulation. More preferably, the weight percent nicotine content of the liquid nicotine formulation is at least about 1.8 times the weight percent polyhydric alcohol content of the liquid nicotine formulation. Most preferably, the weight percent nicotine content of the liquid nicotine formulation is at least about 2 times the weight percent polyhydric alcohol content of the liquid nicotine formulation.

That is, preferably the ratio of the weight percent of nicotine to the weight percent of polyhydric alcohol in the liquid nicotine formulation is greater than or equal to about 1.5, more preferably greater than or equal to about 1.8, most preferably greater than or equal to about 2.

Preferably, the weight percent alkaloid content of the liquid alkaloid formulation is less than or equal to about 8 times the weight percent polyhydric alcohol content of the liquid alkaloid formulation. More preferably, the weight percent alkaloid content of the liquid alkaloid formulation is less than or equal to about 7 times the weight percent polyhydric alcohol content of the liquid alkaloid formulation or less than or equal to about 6 times the weight percent polyhydric alcohol content of the liquid alkaloid formulation. Most preferably, the weight percent alkaloid content of the liquid alkaloid formulation is less than or equal to about 4 times the weight percent polyhydric alcohol content of the liquid alkaloid formulation.

That is, preferably the ratio of the weight percent of alkaloid to the weight percent of polyhydric alcohol in the liquid alkaloid formulation is less than or equal to about 8, more preferably less than or equal to about 7 or less than or equal to about 6, most preferably less than or equal to about 4.

In embodiments in which the liquid alkaloid formulation is a liquid nicotine formulation, preferably the weight percent nicotine content of the liquid nicotine formulation is less than or equal to about 8 times the weight percent polyhydric alcohol content of the liquid nicotine formulation. More preferably, the weight percent nicotine content of the liquid nicotine formulation is less than or equal to about 7 times the weight percent polyhydric alcohol content of the liquid nicotine formulation or less than or equal to about 6 times the weight percent polyhydric alcohol content of the liquid nicotine formulation. Most preferably, the weight percent nicotine content of the liquid nicotine formulation is less than or equal to about 4 times the weight percent polyhydric alcohol content of the liquid nicotine formulation.

That is, preferably the ratio of the weight percent of nicotine to the weight percent of polyhydric alcohol in the liquid nicotine formulation is less than or equal to about 8, more preferably less than or equal to about 7 or less than or equal to about 6, most preferably less than or equal to about 4.

Preferably, the weight percent alkaloid content of the liquid alkaloid formulation is between about 1.5 times and about 9 times the weight percent polyhydric alcohol content of the liquid alkaloid formulation. For example, the weight percent alkaloid content of the liquid alkaloid formulation may be between about 1.8 times and about 9 times the weight percent polyhydric alcohol content of the liquid alkaloid formulation or between about 2 times and about 9 times the weight percent polyhydric alcohol content of the liquid alkaloid formulation. For example, the weight percent alkaloid content of the liquid alkaloid formulation may be between about 1.8 times and about 8 times the weight percent polyhydric alcohol content of the liquid alkaloid formulation or between about 2 times and about 8 times the weight percent polyhydric alcohol content of the liquid alkaloid formulation.

More preferably, the weight percent alkaloid content of the liquid alkaloid formulation is between about 1.5 times and about 7 times the weight percent polyhydric alcohol content of the liquid alkaloid formulation or between about 1.5 times and about 6 times the weight percent polyhydric alcohol content of the liquid alkaloid formulation. For example, the weight percent alkaloid content of the liquid alkaloid formulation may be between about 1.8 times and about 7 times the weight percent polyhydric alcohol content of the liquid alkaloid formulation or between about 1.8 times and about 6 times the weight percent polyhydric alcohol content of the liquid alkaloid formulation. For example, the weight percent alkaloid content of the liquid alkaloid formulation may be between about 2 times and about 7 times the weight percent polyhydric alcohol content of the liquid alkaloid formulation or between about 2 times and about 6 times the weight percent polyhydric alcohol content of the liquid alkaloid formulation.

Most preferably, the weight percent alkaloid content of the liquid alkaloid formulation is between about 1.5 times and about 4 times the weight percent polyhydric alcohol content of the liquid alkaloid formulation. For example, the weight percent alkaloid content of the liquid alkaloid formulation may be between about 1.8 times and about 4 times the weight percent polyhydric alcohol content of the liquid alkaloid formulation or between about 2 times and about 4 times the weight percent polyhydric alcohol content of the liquid alkaloid formulation.

In embodiments in which the liquid alkaloid formulation is a liquid nicotine formulation, preferably the weight percent nicotine content of the liquid nicotine formulation is between about 1.5 times and about 9 times the weight percent polyhydric alcohol content of the liquid nicotine formulation. For example, the weight percent nicotine content of the liquid nicotine formulation may be between about 1.8 times and about 9 times the weight percent polyhydric alcohol content of the liquid nicotine formulation or between about 2 times and about 9 times the weight percent polyhydric alcohol content of the liquid nicotine formulation. For example, the weight percent nicotine content of the liquid nicotine formulation may be between about 1.8 times and about 8 times the weight percent polyhydric alcohol content of the liquid nicotine formulation or between about 2 times and about 8 times the weight percent polyhydric alcohol content of the liquid nicotine formulation.

More preferably, the weight percent nicotine content of the liquid nicotine formulation is between about 1.5 times and about 7 times the weight percent polyhydric alcohol content of the liquid nicotine formulation or between about 1.5 times and about 6 times the weight percent polyhydric alcohol content of the liquid nicotine formulation. For example, the weight percent nicotine content of the liquid nicotine formulation may be between about 1.8 times and about 7 times the weight percent polyhydric alcohol content of the liquid nicotine formulation or between about 1.8 times and about 6 times the weight percent polyhydric alcohol content of the liquid nicotine formulation. For example, the weight percent nicotine content of the liquid nicotine formulation may be between about 2 times and about 7 times the weight percent polyhydric alcohol content of the liquid nicotine formulation or between about 2 times and about 6 times the weight percent polyhydric alcohol content of the liquid nicotine formulation.

Most preferably, the weight percent nicotine content of the liquid nicotine formulation is between about 1.5 times and about 4 times the weight percent polyhydric alcohol content of the nicotine formulation. For example, the weight percent nicotine content of the liquid nicotine formulation may be between about 1.8 times and about 4 times the weight percent polyhydric alcohol content of the liquid nicotine formulation or between about 2 times and about 4 times the weight percent polyhydric alcohol content of the liquid nicotine formulation.

Preferably, the alkaloid content of the liquid alkaloid formulation is at least about 60 percent by weight. More preferably, the alkaloid content of the liquid alkaloid formulation is at least about 65 percent by weight or at least about 70 percent by weight.

In embodiments in which the liquid alkaloid formulation is a liquid nicotine formulation, preferably the nicotine content of the liquid nicotine formulation is at least about 60 percent by weight. More preferably, the nicotine content of the liquid nicotine formulation is at least about 65 percent by weight or at least about 70 percent by weight.

Preferably, the alkaloid content of the liquid alkaloid formulation is less than or equal to about 85 percent by weight. More preferably, the alkaloid content of the liquid alkaloid formulation is less than or equal to about 75 percent by weight or less than or equal to about 80 percent by weight.

In embodiments in which the liquid alkaloid formulation is a liquid nicotine formulation, preferably the nicotine content of the liquid nicotine formulation is less than or equal to about 85 percent by weight. More preferably, the nicotine content of the liquid nicotine formulation is less than or equal to about 75 percent by weight or less than or equal to about 80 percent by weight.

Preferably, the alkaloid content of the liquid alkaloid formulation is between about 60 percent by weight and about 90 percent by weight. For example, the alkaloid content of the liquid alkaloid formulation may be between about 60 percent by weight and about 85 percent by weight, between about 60 percent by weight and about 80 percent by weight or between about 60 percent by weight and about 75 percent by weight.

More preferably, the alkaloid content of the liquid alkaloid formulation is between about 65 percent by weight and about 90 percent by weight or between about 70 percent by weight and about 90 percent by weight. For example, the alkaloid content of the liquid alkaloid formulation may be between about 65 percent by weight and about 85 percent by weight, between about 65 percent by weight and about 80 percent by weight or between about 65 percent by weight and about 75 percent by weight. For example, the alkaloid content of the liquid alkaloid formulation may be between about 70 percent by weight and about 85 percent by weight, between 70 percent by weight and about 80 percent by weight or between about 70 percent by weight and about 75 percent by weight.

In embodiments in which the liquid alkaloid formulation is a liquid nicotine formulation, preferably the nicotine content of the liquid nicotine formulation is between about 60 percent by weight and about 90 percent by weight. For example, the nicotine content of the liquid nicotine formulation may be between about 60 percent by weight and about 85 percent by weight, between about 60 percent by weight and about 80 percent by weight or between about 60 percent by weight and about 75 percent by weight.

More preferably, the nicotine content of the liquid nicotine formulation is between about 65 percent by weight and about 90 percent by weight or between about 70 percent by weight and about 90 percent by weight. For example, the nicotine content of the liquid nicotine formulation may be between about 65 percent by weight and about 85 percent by weight, between about 65 percent by weight and about 80 percent by weight or between about 65 percent by weight and about 75 percent by weight. For example, the nicotine content of the liquid nicotine formulation may be between about 70 percent by weight and about 85 percent by weight, between 70 percent by weight and about 80 percent by weight or between about 70 percent by weight and about 75 percent by weight.

The liquid alkaloid formulation may comprise one or more polyhydric alcohols.

Preferably, the liquid alkaloid formulation comprises one or more polyhydric alcohols selected from the group consisting of propylene glycol, triethylene glycol, 1,3-butanediol and glycerine.

More preferably, the liquid alkaloid formulation comprises glycerine.

Most preferably, the liquid alkaloid formulation comprises vegetable glycerine.

In embodiments in which the liquid alkaloid formulation comprises glycerine, preferably the weight percent alkaloid content of the liquid alkaloid formulation is at least about 1.5 times the weight percent glycerine content of the liquid alkaloid formulation. More preferably, the weight percent alkaloid content of the liquid alkaloid formulation is at least about 1.8 times the weight percent glycerine content of the liquid alkaloid formulation. Most preferably, the weight percent alkaloid content of the liquid alkaloid formulation is at least about 2 times the weight percent glycerine content of the liquid alkaloid formulation.

That is, preferably the ratio of the weight percent of alkaloid to the weight percent of glycerine in the liquid alkaloid formulation is greater than or equal to about 1.5, more preferably greater than or equal to about 1.8, most preferably greater than or equal to about 2.

In embodiments in which the liquid alkaloid formulation comprises glycerine, preferably, the weight percent alkaloid content of the liquid alkaloid formulation is less than or equal to about 8 times the weight percent glycerine content of the liquid alkaloid formulation. More preferably, the weight percent alkaloid content of the liquid alkaloid formulation is less than or equal to about 7 times the weight percent glycerine content of the liquid alkaloid formulation or less than or equal to about 6 times the weight percent glycerine content of the liquid alkaloid formulation. Most preferably, the weight percent alkaloid content of the liquid alkaloid formulation is less than or equal to about 4 times the weight percent glycerine content of the liquid alkaloid formulation.

That is, preferably the ratio of the weight percent of alkaloid to the weight percent of glycerine in the liquid alkaloid formulation is less than or equal to about 8, more preferably less than or equal to about 7 or less than or equal to about 6, most preferably less than or equal to about 4.

In embodiments in which the liquid alkaloid formulation comprises glycerine, preferably the weight percent alkaloid content of the liquid alkaloid formulation is between about 1.5 times and about 9 times the weight percent glycerine content of the liquid alkaloid formulation. For example, the weight percent alkaloid content of the liquid alkaloid formulation may be between about 1.8 times and about 9 times the weight percent glycerine content of the liquid alkaloid formulation or between about 2 times and about 9 times the weight percent glycerine content of the liquid alkaloid formulation. For example, the weight percent alkaloid content of the liquid alkaloid formulation may be between about 1.8 times and about 8 times the weight percent glycerine content of the liquid alkaloid formulation or between about 2 times and about 8 times the weight percent glycerine content of the liquid alkaloid formulation.

More preferably, the weight percent alkaloid content of the liquid alkaloid formulation is between about 1.5 times and about 7 times the weight percent glycerine content of the liquid alkaloid formulation or between about 1.5 times and about 6 times the weight percent glycerine content of the liquid alkaloid formulation. For example, the weight percent alkaloid content of the liquid alkaloid formulation may be between about 1.8 times and about 7 times the weight percent glycerine content of the liquid alkaloid formulation or between about 1.8 times and about 6 times the weight percent glycerine content of the liquid alkaloid formulation. For example, the weight percent alkaloid content of the liquid alkaloid formulation may be between about 2 times and about 7 times the weight percent glycerine content of the liquid alkaloid formulation or between about 2 times and about 6 times the weight percent glycerine content of the liquid alkaloid formulation.

Most preferably, the weight percent alkaloid content of the liquid alkaloid formulation is between about 1.5 times and about 4 times the weight percent glycerine content of the liquid alkaloid formulation. For example, the weight percent alkaloid content of the liquid alkaloid formulation may be between about 1.8 times and about 4 times the weight percent glycerine content of the liquid alkaloid formulation or between about 2 times and about 4 times the weight percent glycerine content of the liquid alkaloid formulation.

In particularly preferred embodiments, the liquid alkaloid formulation is a liquid nicotine formulation having a glycerine content of at least about 10 percent by weight and a nicotine content of at least about 10 percent by weight.

In embodiments in which the liquid alkaloid formulation is a liquid nicotine formulation and comprises glycerine, preferably the weight percent nicotine content of the liquid nicotine formulation is at least about 1.5 times the weight percent glycerine content of the liquid nicotine formulation. More preferably, the weight percent nicotine content of the liquid nicotine formulation is at least about 1.8 times the weight percent glycerine content of the liquid nicotine formulation. Most preferably, the weight percent nicotine content of the liquid nicotine formulation is at least about 2 times the weight percent glycerine content of the liquid nicotine formulation.

That is, preferably the ratio of the weight percent of nicotine to the weight percent of glycerine in the liquid nicotine formulation is greater than or equal to about 1.5, more preferably greater than or equal to about 1.8, most preferably greater than or equal to about 2.

In embodiments in which the liquid alkaloid formulation is a liquid nicotine formulation and comprises glycerine, preferably the weight percent nicotine content of the liquid nicotine formulation is less than or equal to about 8 times the weight percent glycerine content of the liquid nicotine formulation. More preferably, the weight percent nicotine content of the liquid nicotine formulation is less than or equal to about 7 times the weight percent glycerine content of the liquid nicotine formulation or less than or equal to about 6 times the weight percent glycerine content of the liquid nicotine formulation. Most preferably, the weight percent nicotine content of the liquid nicotine formulation is less than or equal to about 4 times the weight percent glycerine content of the liquid nicotine formulation.

That is, preferably the ratio of the weight percent of nicotine to the weight percent of glycerine in the liquid nicotine formulation is less than or equal to about 8, more preferably less than or equal to about 7 or less than or equal to about 6, most preferably less than or equal to about 4.

In embodiments in which the liquid alkaloid formulation is a liquid nicotine formulation and comprises glycerine, preferably the weight percent nicotine content of the liquid nicotine formulation is between about 1.5 times and about 9 times the weight percent glycerine content of the liquid nicotine formulation. For example, the weight percent nicotine content of the liquid nicotine formulation may be between about 1.8 times and about 9 times the weight percent glycerine content of the liquid nicotine formulation or between about 2 times and about 9 times the weight percent glycerine content of the liquid nicotine formulation. For example, the weight percent nicotine content of the liquid nicotine formulation may be between about 1.8 times and about 8 times the weight percent glycerine content of the liquid nicotine formulation or between about 2 times and about 8 times the weight percent glycerine content of the liquid nicotine formulation.

More preferably, the weight percent nicotine content of the liquid nicotine formulation is between about 1.5 times and about 7 times the weight percent glycerine content of the liquid nicotine formulation or between about 1.5 times and about 6 times the weight percent glycerine content of the liquid nicotine formulation. For example, the weight percent nicotine content of the liquid nicotine formulation may be between about 1.8 times and about 7 times the weight percent glycerine content of the liquid nicotine formulation or between about 1.8 times and about 6 times the weight percent glycerine content of the liquid nicotine formulation. For example, the weight percent nicotine content of the liquid nicotine formulation may be between about 2 times and about 7 times the weight percent glycerine content of the liquid nicotine formulation or between about 2 times and about 6 times the weight percent glycerine content of the liquid nicotine formulation.

Most preferably, the weight percent nicotine content of the liquid nicotine formulation is between about 1.5 times and about 4 times the weight percent glycerine content of the nicotine formulation. For example, the weight percent nicotine content of the liquid nicotine formulation may be between about 1.8 times and about 4 times the weight percent glycerine content of the liquid nicotine formulation or between about 2 times and about 4 times the weight percent glycerine content of the liquid nicotine formulation.

Preferably, the polyhydric alcohol content of the liquid alkaloid formulation is at least about 15 percent by weight.

More preferably, the polyhydric alcohol content of the liquid alkaloid formulation is at least about 20 percent by weight.

In embodiments in which the liquid alkaloid formulation comprises glycerine, preferably the glycerine content of the liquid alkaloid formulation is at least about 15 percent by weight.

In embodiments in which the liquid alkaloid formulation comprises glycerine, more preferably the glycerine content of the liquid alkaloid formulation is at least about 20 percent by weight.

Preferably, the polyhydric alcohol content of the liquid alkaloid formulation is less than or equal to about 40 percent by weight. More preferably, the polyhydric alcohol content of the liquid alkaloid formulation is less than or equal to about 35 percent by weight or less than or equal to about 30 percent by weight.

This may advantageously ensure that inclusion of polyhydric alcohol in the liquid alkaloid formulation does not adversely affect in situ reaction between alkaloid and acid during use of an aerosol-generating system comprising the cartridge.

In embodiments in which the liquid alkaloid formulation comprises glycerine, preferably the glycerine content of the liquid alkaloid formulation is less than or equal to about 40 percent by weight. More preferably, the glycerine content of the liquid alkaloid formulation is less than or equal to about 35 percent by weight or less than or equal to about 30 percent by weight.

Preferably, the polyhydric alcohol content of the liquid alkaloid formulation is between about 10 percent by weight and about 40 percent by weight. For example, the polyhydric alcohol content of the liquid alkaloid formulation may be between about 15 percent by weight and about 40 percent by weight or between about 20 percent by weight and about 40 percent by weight.

More preferably, the polyhydric alcohol content of the liquid alkaloid formulation is between about 10 percent by weight and about 35 percent by weight or between about 10 percent by weight and about 30 percent by weight. For example, the polyhydric alcohol content of the liquid alkaloid formulation may be between about 15 percent by weight and about 35 percent by weight or between about 20 percent by weight and about 35 percent by weight. For example, the polyhydric alcohol content of the liquid alkaloid formulation may be between about 15 percent by weight and about 30 percent by weight or between about 20 percent by weight and about 30 percent by weight.

In embodiments in which the liquid alkaloid formulation comprises glycerine, preferably the glycerine content of the liquid alkaloid formulation is between about 10 percent by weight and about 40 percent by weight. For example, the glycerine content of the liquid alkaloid formulation may be between about 15 percent by weight and about 40 percent by weight or between about 20 percent by weight and about 40 percent by weight.

More preferably, the glycerine content of the liquid alkaloid formulation is between about 10 percent by weight and about 35 percent by weight or between about 10 percent by weight and about 30 percent by weight. For example, the glycerine content of the liquid alkaloid formulation may be between about 15 percent by weight and about 35 percent by weight or between about 20 percent by weight and about 35 percent by weight. For example, the glycerine content of the liquid alkaloid formulation may be between about 15 percent by weight and about 30 percent by weight or between about 20 percent by weight and about 30 percent by weight.

Preferably, the liquid alkaloid formulation has a combined polyhydric alcohol content and alkaloid content of at least about 95 percent by weight. More preferably, the liquid alkaloid formulation has a combined polyhydric alcohol content and alkaloid content of at least about 97 percent by weight. Most preferably, the liquid alkaloid formulation has a combined polyhydric alcohol content and alkaloid content of at least about 99 percent by weight.

In embodiments in which the liquid alkaloid formulation is a liquid nicotine formulation and comprises glycerine, preferably the liquid nicotine formulation has a combined glycerine content and nicotine content of at least about 95 percent by weight. More preferably, the liquid nicotine formulation has a combined glycerine content and nicotine content of at least about 97 percent by weight. Most preferably, the liquid nicotine formulation has a combined glycerine content and nicotine content of at least about 99 percent by weight.

The liquid alkaloid formulation may comprise one or more flavourants. Suitable flavourants include, but are not limited to, menthol.

Preferably, the liquid alkaloid formulation has a flavourant content of less than or equal to about 1 percent by weight.

Advantageously, the alkaloid source comprises a first carrier material impregnated with the liquid alkaloid formulation.

The first carrier material acts as a reservoir for the liquid alkaloid formulation.

Advantageously, the first carrier material is chemically inert with respect to the liquid alkaloid formulation.

The first carrier material may have any suitable shape and size. For example, the first carrier material may be in the form of a sheet or plug.

Advantageously, the shape and of the first carrier material is similar to the shape and size of the first compartment of the cartridge.

The shape, size, density and porosity of the first carrier material may be chosen to allow the first carrier material to be impregnated with a desired amount of the liquid alkaloid formulation.

Advantageously, the alkaloid source comprises a first carrier material impregnated with greater than or equal to about 10 microlitres of the liquid alkaloid formulation. For example, the alkaloid source may comprise a first carrier material impregnated with greater than or equal to about 15 microlitres of the liquid alkaloid formulation.

For example, the alkaloid source may comprise a first carrier material impregnated with between about 10 microlitres and about 25 microlitres of the liquid alkaloid formulation or between about 15 microlitres and about 25 microlitres of the liquid alkaloid formulation.

Advantageously, the alkaloid source comprises a first carrier material impregnated with less than or equal to about 25 microlitres of the liquid alkaloid formulation. For example, the alkaloid source may comprise a first carrier material impregnated with less than or equal to about 20 microlitres of the liquid alkaloid formulation.

For example, the alkaloid source may comprise a first carrier material impregnated with between about 10 microlitres and about 20 microlitres of the liquid alkaloid formulation or between about 15 microlitres and about 20 microlitres of the liquid alkaloid formulation.

In embodiments in which the liquid alkaloid formulation is a liquid nicotine formulation, the liquid nicotine formulation may comprise between about 1 milligram and about 40 milligrams of nicotine. For example, liquid nicotine formulation may comprise between about 3 milligram and about 30 milligram of nicotine, between about 6 milligram and about 20 milligram of nicotine or between about 8 milligram and about 18 milligram of nicotine.

The acid source may comprise an organic acid or an inorganic acid.

Preferably, the acid source comprises an organic acid, more preferably a carboxylic acid, most preferably an alpha-keto or 2-oxo acid or lactic acid.

Advantageously, the acid source comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. Advantageously, the acid source comprises pyruvic acid or lactic acid. More advantageously, the acid source comprises lactic acid.

Advantageously, the second compartment of the cartridge contains an acid source comprising a second carrier material impregnated with acid.

The second carrier material acts as a reservoir for the acid.

Advantageously, the second carrier material is chemically inert with respect to the acid.

The second carrier material may have any suitable shape and size. For example, the second carrier material may be in the form of a sheet or plug.

Advantageously, the shape and size of the second carrier material is similar to the shape and size of the second compartment of the cartridge.

The shape, size, density and porosity of the second carrier material may be chosen to allow the second carrier material to be impregnated with a desired amount of acid.

Advantageously, the acid source comprises a second carrier material impregnated with greater than or equal to about 10 microlitres of acid. For example, the acid source may comprise a second carrier material impregnated with greater than or equal to about 15 microlitres of acid.

For example, the acid source may comprise a second carrier material impregnated with between about 10 microlitres and about 25 microlitres of acid or between about 15 microlitres and about 25 microlitres of acid.

Advantageously, the acid source comprises a second carrier material impregnated with less than or equal to about 25 microlitres of acid. For example, the acid source may comprise a second carrier material impregnated with less than or equal to about 20 microlitres of acid.

For example, the acid source may comprise a second carrier material impregnated with between about 10 microlitres and about 20 microlitres of acid or between about 15 microlitres and about 20 microlitres of acid.

In embodiments in which the acid source comprises lactic acid, advantageously the acid source comprises a second carrier material impregnated with between about 2 milligrams and about 60 milligrams of lactic acid.

For example, the acid source may comprise a second carrier material impregnated with between about 5 milligrams and about 50 milligrams of lactic acid, between about 8 milligrams and about 40 milligrams of lactic acid or between about 10 milligrams and about 30 milligrams of lactic acid.

In embodiments in which the alkaloid source comprises a first carrier material impregnated with the liquid alkaloid formulation and the acid source comprises a second carrier material impregnated with acid, the first carrier material and the second carrier material may be the same or different.

The first carrier material and the second carrier material may comprise one or more of glass, cellulose, ceramic, stainless steel, aluminium, polyethylene (PE), polypropylene, polyethylene terephthalate (PET), poly(cyclohexanedimethylene terephthalate) (PCT), polybutylene terephthalate (PBT), polytetrafluoroethylene (PTFE), expanded polytetrafluoroethylene (ePTFE), and BAREX®.

Advantageously, the first carrier material and the second carrier material have a density of between about 0.1 grams/cubic centimetre and about 0.3 grams/cubic centimetre.

Advantageously, the first carrier material and the second carrier material have a porosity of between about 15 percent and about 55 percent.

The shape and dimensions of the first compartment of the cartridge may be chosen to allow a desired amount of liquid alkaloid formulation to be housed in the cartridge.

The shape and dimensions of the second compartment of the cartridge may be chosen to allow a desired amount of acid to be housed in the cartridge.

The shape and dimensions of the first compartment and the second compartment of the cartridge may be the same or different.

The first compartment of the cartridge may have a length $L_1$ of between about 8 millimetres and about 40 millimetres, for example of between about 10 millimetres and about 20 millimetres. The first compartment of the cartridge may have a width $W_1$ of between about 4 millimetres and about 6 millimetres. The first compartment of the cartridge may have a height $H_1$ of between about 0.5 millimetres and about 2.5 millimetres.

The first compartment of the cartridge may have any suitable transverse cross-sectional shape. For example, the transverse cross-sectional shape of the first compartment may be circular, semi-circular, elliptical, triangular, square, rectangular or trapezoidal.

The second compartment of the cartridge may have a length $L_2$ of between about 8 millimetres and about 40 millimetres, for example of between about 10 millimetres and about 20 millimetres. The second compartment of the cartridge may have a width $W_2$ of between about 4 millimetres and about 6 millimetres. The second compartment of the cartridge may have a height $H_2$ of between about 0.5 millimetres and about 2.5 millimetres.

The second compartment of the cartridge may have any suitable transverse cross-sectional shape. For example, the transverse cross-sectional shape of the second compartment may be circular, semi-circular, elliptical, triangular, square, rectangular or trapezoidal.

The ratio of alkaloid and acid required to achieve an appropriate reaction stoichiometry may be controlled and balanced through variation of the volume of the first compartment relative to the volume of the second compartment.

Advantageously, the first compartment comprises a first air inlet and a first air outlet.

The first air outlet of the first compartment of the cartridge is located at the proximal end of the first compartment of the cartridge. The first air inlet of the first compartment of the cartridge is located upstream of the first air outlet of the first compartment of the cartridge.

Advantageously the second compartment comprises a second air inlet and a second air outlet.

The second air outlet of the second compartment of the cartridge is located at the proximal end of the second compartment of the cartridge. The second air inlet of the second compartment of the cartridge is located upstream of the second air outlet of the second compartment of the cartridge.

As used herein with reference to the invention, the term "air inlet" describes one or more apertures through which air may be drawn into a component or portion of a component of the cartridge.

As used herein with reference to the invention, the term "air outlet" describes one or more apertures through which air may be drawn out of a component or portion of a component of the cartridge.

The first air inlet of the first compartment of the cartridge and the second air inlet of the second compartment of the cartridge may each comprise one or more apertures. For example, the first air inlet of the first compartment of the cartridge and the second air inlet of the second compartment of the cartridge may each comprise one, two, three, four, five, six or seven apertures.

The first air inlet of the first compartment of the cartridge and the second air inlet of the second compartment of the cartridge may comprise the same or different numbers of apertures.

Advantageously, the first air inlet of the first compartment of the cartridge and the second air inlet of the second compartment of the cartridge each comprise a plurality of apertures. For example, the first air inlet of the first compartment of the cartridge and the second air inlet of the second compartment of the cartridge may each comprise two, three, four, five, six or seven apertures.

Providing a first compartment having a first air inlet comprising a plurality of apertures and a second compartment having a second air inlet comprising a plurality of apertures may advantageously result in more homogeneous airflow within the first compartment and the second compartment, respectively. In use, this may improve entrainment of alkaloid in an air stream drawn through the first compartment and improve entrainment of acid in an air stream drawn through the second compartment.

The ratio of alkaloid and acid required to achieve an appropriate reaction stoichiometry may be controlled and balanced through variation of the volumetric airflow through the first compartment of the cartridge relative to the volumetric airflow through the second compartment of the cartridge. The ratio of the volumetric airflow through the first compartment relative to the volumetric airflow through the second compartment may be controlled through variation of one or more of the number, dimensions and location of the apertures forming the first air inlet of the first compartment of the cartridge relative to the number, dimensions and location of the apertures forming the second air inlet of the second compartment of the cartridge.

Advantageously, prior to first use of the cartridge, one or both of the first air inlet of the first compartment and the second air inlet of the second compartment may be sealed by one or more removable or frangible barriers. For example, one or both of the first air inlet of the first compartment and the second air inlet of the second compartment may be sealed by one or more peel-off seals or pierceable seals.

The one or more removable or frangible barriers may be formed from any suitable material. For example, the one or more removable or frangible barriers may be formed from a metal foil or film.

The first air outlet of the first compartment of the cartridge and the second air outlet of the second compartment of the cartridge may each comprise one or more apertures. For example, the first air outlet of the first compartment of the cartridge and the second air outlet of the second compartment of the cartridge may each comprise one, two, three, four, five, six or seven apertures.

The first air outlet of the first compartment of the cartridge and the second air outlet of the second compartment of the cartridge may comprise the same or different numbers of apertures.

Advantageously, the first air outlet of the first compartment of the cartridge and the second air outlet of the second compartment of the cartridge may each comprise a plurality of apertures. For example, the first air outlet of the first compartment of the cartridge and the second air outlet of the second compartment of the cartridge may each comprise two, three, four, five, six or seven apertures. Providing a first compartment having a first air outlet comprising a plurality of apertures and a second compartment having a second air outlet comprising a plurality of apertures may advantageously result in more homogeneous airflow within the first compartment and the second compartment, respectively. In use, this may improve entrainment of alkaloid in an air stream drawn through the first compartment and improve entrainment of acid in an air stream drawn through the second compartment.

As described above, the ratio of alkaloid and acid required to achieve an appropriate reaction stoichiometry may be controlled and balanced through variation of the volumetric airflow through the first compartment of the cartridge relative to the volumetric airflow through the second compartment of the cartridge. The ratio of the volumetric airflow through the first compartment relative to the volumetric airflow through the second compartment may be controlled through variation of one or more of the number, dimensions and location of the apertures forming the first air outlet of the first compartment of the cartridge relative to the number, dimensions and location of the apertures forming the second air outlet of the second compartment of the cartridge.

Advantageously, prior to first use of the cartridge, one or both of the first air outlet of the first compartment and the second air outlet of the second compartment may be sealed by one or more removable or frangible barriers. For example, one or both of the first air outlet of the first compartment and the second air outlet of the second compartment may be sealed by one or more peel-off seals or pierceable seals.

The one or more removable or frangible barriers may be formed from any suitable material. For example, the one or more removable or frangible barriers may be formed from a metal foil or film.

The first compartment and the second compartment may be arranged in series within the cartridge.

As used herein with reference to the invention, by "series" it is meant that the first compartment and the second compartment are arranged within the cartridge so that in use an air stream drawn through the cartridge passes through one of the first compartment and the second compartment and then passes through the other of the first compartment and the second compartment. Alkaloid vapour and polyhydric alcohol vapour is released from the alkaloid source in the first compartment into the air stream drawn through the cartridge and acid vapour is released from the acid source in the second compartment into the air stream drawn through the cartridge. The alkaloid vapour reacts with the acid vapour in the gas phase to form an aerosol. As described above, the sensorial harshness of the aerosol is perceived to be lower by a user due to the presence of polyhydric alcohol within the aerosol.

Where the first compartment and the second compartment are arranged in series within the cartridge, the second compartment may be located downstream of the first compartment so that in use an air stream drawn through the cartridge passes into the first compartment through the first air inlet, through the first compartment and out of the first compartment through the first air outlet and then passes into the second compartment through the second air inlet, through the second compartment and out of the second compartment through the second air outlet. In such embodiments, the alkaloid vapour may react with the acid vapour in the second compartment to form an aerosol. In such embodiments the cartridge may further comprise a third compartment downstream of the second compartment and in fluid communication with the second air outlet of the second compartment. The alkaloid vapour may react with the acid vapour in the third compartment to form an aerosol.

Alternatively, where the first compartment and the second compartment are arranged in series within the cartridge, the second compartment may be located upstream of the first compartment so that in use an air stream drawn through the cartridge passes into the second compartment through the second air inlet, through the second compartment and out of the second compartment through the second air outlet and then passes into the first compartment through the first air inlet, through the first compartment and out of the first compartment through the first air outlet. In such embodiments, the acid vapour may react with the alkaloid vapour in the second compartment to form an aerosol. In such embodiments the cartridge may further comprise a third compartment downstream of the first compartment and in fluid communication with the first air outlet of the first compartment. The acid vapour may react with the alkaloid vapour in the third compartment to form an aerosol.

Advantageously, the first compartment and the second compartment are arranged in parallel within the cartridge.

As used herein with reference to the invention, by "parallel" it is meant that the first compartment and the second compartment are arranged within the cartridge so that in use a first air stream drawn through the cartridge passes into the first compartment through the first air inlet, downstream through the first compartment and out of the first compartment through the first air outlet and a second air stream drawn through the cartridge passes into the second compartment through the second air inlet, downstream through the second compartment and out of the second compartment through the second air outlet. Alkaloid vapour and polyhydric alcohol vapour is released from the alkaloid source in the first compartment into the first air stream drawn through the cartridge and acid vapour is released from the acid source in the second compartment into the second air stream drawn through the cartridge. The alkaloid vapour in the first air stream reacts with the acid vapour in the second air stream in the gas phase to form an aerosol. As described above, the sensorial harshness of the aerosol is perceived to be lower by a user due to the presence of polyhydric alcohol within the aerosol.

In such embodiments the cartridge may further comprise a third compartment downstream of the first compartment and the second compartment and in fluid communication with the first air outlet of the first compartment and the second air outlet of the second compartment. The alkaloid vapour in the first air stream may react with the acid vapour in the second air stream in the third compartment to form an aerosol.

In embodiments in which the cartridge further comprises a third compartment, the third compartment may comprise one or more aerosol-modifying agents. For example, the third compartment may comprise one or more sorbents, one or more flavourants, one or more chemesthetic agents or a combination thereof.

The first compartment and the second compartment may be arranged symmetrically with respect to each other within the cartridge.

Advantageously, the cartridge is an elongate cartridge. In embodiments in which the cartridge is an elongate cartridge, the first compartment and the second compartment of the cartridge may be arranged symmetrically about the longitudinal axis of the cartridge.

The cartridge may have any suitable shape. For example, the cartridge may be substantially cylindrical.

The cartridge may have any suitable transverse cross-sectional shape. For example, the transverse cross-sectional shape of the cartridge may be circular, semi-circular, elliptical, triangular, square, rectangular or trapezoidal.

The cartridge may have any suitable size.

For example, the cartridge may have a length of between about 5 millimetres and about 50 millimetres. Advantageously, the cartridge may have a length between about 10 millimetres and about 20 millimetres.

For example, the cartridge may have a width of between about 4 millimetres and about 10 millimetres and a height of between about 4 millimetres and about 10 millimetres. Advantageously, the cartridge may have a width of between about 6 millimetres and about 8 millimetres and a height of between about 6 millimetres and about 8 millimetres.

The cartridge may comprise a body portion and one or more end caps.

The cartridge may comprise a body portion and a distal end cap.

The cartridge may comprise a body portion and a proximal end cap.

The cartridge may comprise a body portion, a distal end cap and a proximal end cap.

In embodiments in which the cartridge comprises a distal end cap, one or more apertures forming the first air inlet of the first compartment of the cartridge and one or more apertures forming the second air inlet of the second compartment of the cartridge may be provided in the distal end cap.

In embodiments in which the cartridge comprises a proximal end cap, one or more apertures forming the first air outlet of the first compartment of the cartridge and one or more apertures forming the second air outlet of the second compartment of the cartridge may be provided in the proximal end cap.

The cartridge may be formed from any suitable material or combination of materials. Suitable materials include, but are not limited to, aluminium, polyether ether ketone (PEEK), polyimides, such as Kapton®, polyethylene terephthalate (PET), polyethylene (PE), high-density polyethylene (HDPE), polypropylene (PP), polystyrene (PS), fluorinated ethylene propylene (FEP), polytetrafluoroethylene (PTFE), polyoxymethylene (POM), epoxy resins, polyurethane resins, vinyl resins, liquid crystal polymers (LCP) and modified LCPs, such as LCPs with graphite or glass fibres.

In embodiments in which the cartridge comprises a body portion and one or more end caps, the body portion and the one or more end caps may be formed from the same or different materials.

The cartridge may be formed from one or more materials that are alkaloid-resistant and acid-resistant.

The first compartment of the cartridge may be coated with one or more alkaloid-resistant materials and the second compartment of the cartridge may be coated with one or more acid-resistant materials.

Examples of suitable alkaloid-resistant materials and acid-resistant materials may include, but are not limited to, polyethylene (PE), polypropylene (PP), polystyrene (PS), fluorinated ethylene propylene (FEP), polytetrafluoroethylene (PTFE), epoxy resins, polyurethane resins, vinyl resins and combinations thereof.

Use of one or more alkaloid-resistant materials to one or both of form the cartridge and coat the interior of the first compartment of the cartridge may advantageously enhance the shelf life of the cartridge.

Use of one or more acid-resistant materials to one or both of form the cartridge and coat the interior of the second compartment of the cartridge may advantageously enhance the shelf life of the cartridge.

The cartridge may be formed from one or more thermally conductive materials.

The first compartment of the cartridge and the second compartment of the cartridge may be coated with one or more thermally conductive materials.

Use of one or more thermally conductive materials to one or both of form the cartridge and coat the interior of the first compartment and the second compartment of the cartridge may advantageously increase heat transfer from a heating element to the alkaloid source and the acid source.

Suitable thermally conductive materials include, but are not limited to, metals such as, for example, aluminium. chromium, copper, gold, iron, nickel and silver, alloys, such as brass and steel and combinations thereof.

The cartridge may be formed of one or more materials having a low resistivity or a high resistivity depending on whether the first compartment and the second compartment are heated by conduction or induction.

The first compartment of the cartridge and the second compartment of the cartridge may be coated with one or more materials having a low resistivity or a high resistivity depending on whether the first compartment and the second compartment are heated by conduction or induction.

The cartridge may be formed by any suitable method. Suitable methods include, but are not limited to, deep drawing, injection moulding, blistering, blow forming and extrusion.

The cartridge may be designed to be disposed of once the liquid alkaloid formulation in the first compartment and the acid in the second compartment are depleted.

The cartridge may be designed to be refillable.

The cartridge may comprise a heating element configured to heat the first compartment and the second compartment. In such embodiments, the heating element is advantageously located between the first compartment and the second compartment. That is the first compartment and the second compartment are disposed on either side of the heating element.

The heating element may be an electrical heating element. The heating element may comprise a resistive heating element.

Advantageously, the heating element is configured to heat the first compartment and the second compartment of the cartridge to a temperature of below about 250 degrees Celsius. Preferably, the heating element is configured to heat the first compartment and the second compartment of the cartridge to a temperature of between about 80 degrees Celsius and about 150 degrees Celsius.

Advantageously, the heating element is configured to heat the first compartment and the second compartment of the cartridge to substantially the same temperature.

As used herein with reference to the invention, by "substantially the same temperature" it is meant that the difference in temperature between the first compartment and the second compartment of the cartridge measured at corresponding locations relative to the heating element is less than about 3° C.

In use, heating the first compartment and the second compartment of the cartridge to a temperature above ambient temperature advantageously enables the vapour concentrations of alkaloid in the first compartment of the cartridge and the vapour pressure of acid in the second compartment of the cartridge to be controlled and balanced proportionally to yield an efficient reaction stoichiometry between the alkaloid and the acid. Advantageously, this may improve the efficiency of aerosol formation and the consistency of aerosol delivery to a user. Advantageously, it may also reduce the delivery of unreacted alkaloid and unreacted acid to a user.

Advantageously the cartridge may comprise a cavity for receiving a heating element configured to heat the first compartment and the second compartment. In such embodiments, the cavity is advantageously located between the first compartment and the second compartment. That is the first compartment and the second compartment are disposed on either side of the cavity.

Advantageously, the cavity extends from the distal end of the cartridge at least part way along the length of the cartridge.

Advantageously, the cavity extends along the longitudinal axis of the cartridge.

The cavity may extend from the distal end of the cartridge to the proximal end of the cartridge. In such embodiments, the cavity has an open distal end and an open proximal end.

The cavity may extend from the distal end of the cartridge part way along the length of the cartridge. In such embodiments, the cavity has an open distal end and a closed proximal end.

The cavity may be enclosed along its length.

The cavity may be at least partially open along its length. This may advantageously facilitate insertion of a heating element into the cavity.

Advantageously, the cartridge may comprise a susceptor for inductively heating the first compartment and the second compartment. In such embodiments, the susceptor is advantageously located between the first compartment and the second compartment. That is the first compartment and the second compartment are disposed on either side of the susceptor.

According to the invention there is further provided an aerosol-generating system comprising: a cartridge according to the invention; and an aerosol-generating device comprising: a housing defining a device cavity configured to receive at least a portion of the cartridge; and a heating element for heating the first compartment and the second compartment of the cartridge.

The aerosol-generating system may advantageously comprise a consumable cartridge according to the invention and a reusable aerosol-generating device comprising a housing defining a device cavity configured to receive at least a portion of the cartridge and a heating element for heating the first compartment and the second compartment of the cartridge.

The heating element may be an electrical heating element. The heating element may comprise a resistive heating element.

The heating element may be an inductive heating element. The inductive heating element may comprise an inductor coil. In such embodiments, the inductive heating element may advantageously circumscribe at least a portion of the device cavity of the aerosol-generating device.

In such embodiments, during use, the inductive heating element generates an alternating magnetic field to generate eddy currents and hysteresis losses in a susceptor in the cartridge, causing the susceptor to heat up, thereby heating the first compartment and the second compartment of the cartridge.

The heating element may be located within the device cavity of the aerosol-generating device.

Advantageously, the heating element may be located within the device cavity of the aerosol-generating device and the cartridge may comprise a cavity for receiving the heating element as described above. In use, the heating element is received within cavity of the cartridge and heats the first compartment and the second compartment of the cartridge.

In such embodiments, the heating element of the aerosol-generating device may advantageously be an elongate heating element in the form of a heating element blade having a width that is greater than the thickness thereof and the cavity of the cartridge may be configured as an elongate slot.

The heating element may circumscribe at least a portion of the device cavity.

In such embodiments, the heating element may be arranged to circumscribe at least a portion of the cartridge when at least a portion of the cartridge is received within the device cavity.

Advantageously, the heating element may be an inductor coil and the cartridge may comprise a susceptor for inductively heating the first compartment and the second compartment of the cartridge as described above.

Advantageously, the heating element is configured to heat the first compartment and the second compartment of the cartridge to a temperature of below about 250 degrees Celsius. Preferably, the heating element is configured to heat the first compartment and the second compartment of the cartridge to a temperature of between about 80 degrees Celsius and about 150 degrees Celsius.

Advantageously, the heating element is configured to heat the first compartment and the second compartment of the cartridge to substantially the same temperature.

As used herein with reference to the invention, by "substantially the same temperature" it is meant that the difference in temperature between the first compartment and the second compartment of the cartridge measured at corresponding locations relative to the heating element is less than about 3 degrees Celsius.

In use, heating the first compartment and the second compartment of the cartridge to a temperature above ambient temperature advantageously enables the vapour concentrations of the alkaloid in the first compartment of the cartridge and the vapour pressure of the acid in the second compartment of the cartridge to be controlled and balanced proportionally to yield an efficient reaction stoichiometry between the alkaloid and the acid. Advantageously, this may improve the efficiency of the aerosol formation and the consistency of the aerosol delivery to a user. Advantageously, it may also reduce the delivery of unreacted alkaloid and unreacted acid to a user.

The aerosol-generating system may further comprise a power supply for supplying power to the heating element and a controller configured to control a supply of power from the power supply to the heating element.

The aerosol-generating device may comprise one or more temperature sensors configured to sense the temperature of the heating element and the temperature of the first compartment and the second compartment of the cartridge. In such embodiments, the controller may be configured to control a supply of power to the heating element based on the sensed temperature.

The aerosol-generating system may further comprise a mouthpiece. In such embodiments, alkaloid vapour released from the alkaloid source in the first compartment of the cartridge and acid vapour released from the acid source in the second compartment of the cartridge may react with one another in the gas phase in the mouthpiece to form an aerosol.

The mouthpiece may be configured for engagement with the cartridge.

In embodiments in which the mouthpiece is configured for engagement with the cartridge, the combination of the cartridge and the mouthpiece may simulate the shape and dimensions of a combustible smoking article, such as a cigarette, a cigar, or a cigarillo. Advantageously, in such embodiments the combination of the cartridge and the mouthpiece may simulate the shape and dimensions of a cigarette.

The mouthpiece may be configured for engagement with the housing of the aerosol-generating device.

The mouthpiece may be designed to be disposed of once the alkaloid in the first compartment and the acid in the second compartment are depleted.

The mouthpiece may be designed to be reusable. In embodiments in which the mouthpiece is designed to be reusable, the mouthpiece may advantageously be configured to be removably attached to the cartridge or the housing of the aerosol-generating device.

For the avoidance of doubt, features described above in relation to one aspect of the invention may also be applicable to other aspects of the invention. In particular, features described above in relation to the cartridge of the invention may also relate, where appropriate, to the aerosol-generating system of the invention, and vice versa.

Figure 2:
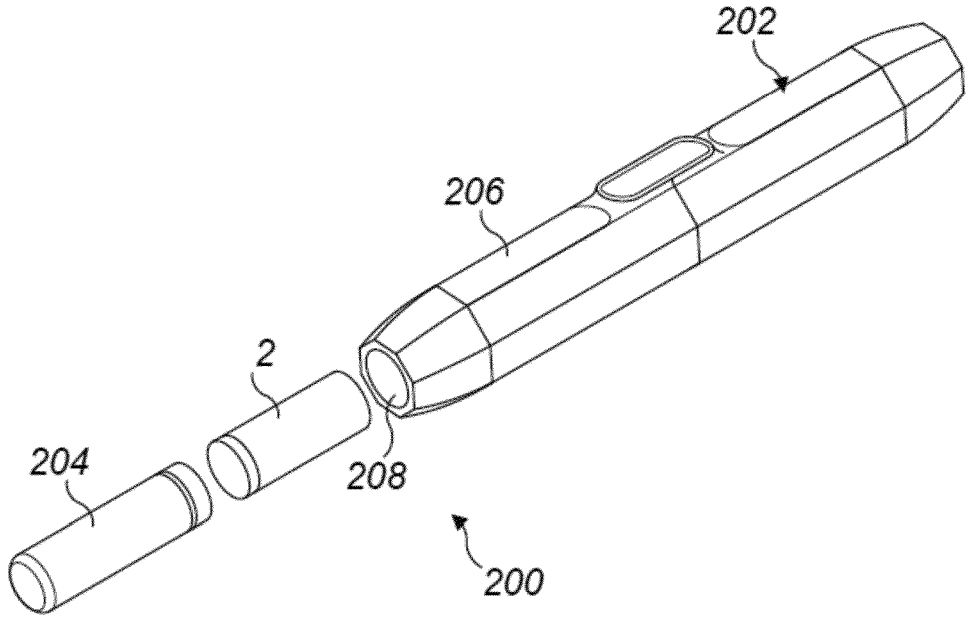
Figure 3A:
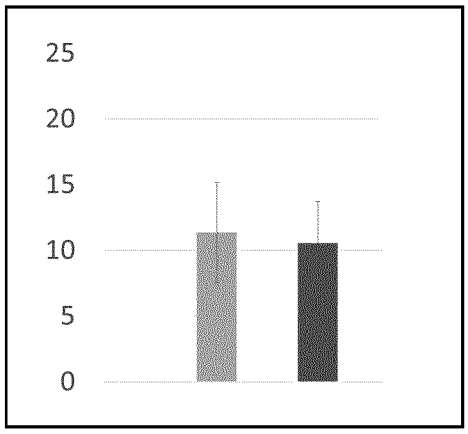
Figure 3B:
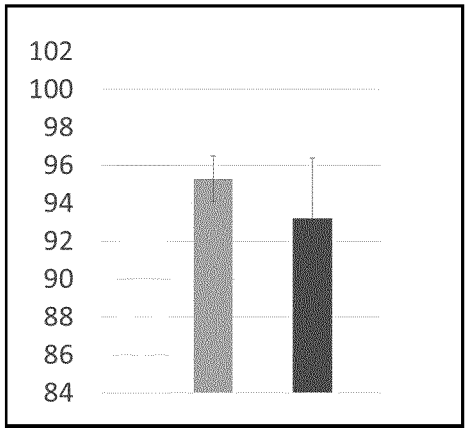
Figure 3C:
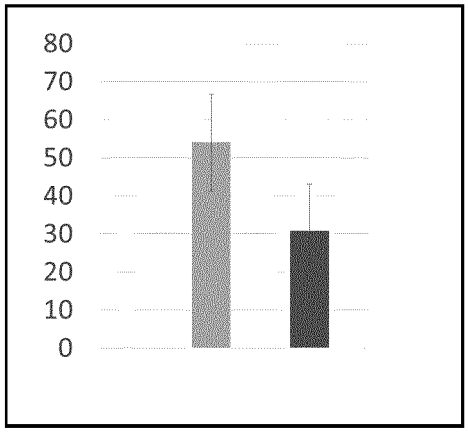

Embodiments of the invention will now be described, by way of example only, with reference to the accompanying drawings, in which:

FIG. 1 shows a cartridge according to an embodiment of the invention;

FIG. 2 shows an aerosol-generating system according to an embodiment of the invention; and FIGS. 3A-C show the: percentage by volume of droplets having a particle size below 5 microns (FIG. 3A); transmittance (FIG. 3B) and; average amount of alkaloid (nicotine) delivered per puff for aerosols generated by an aerosol-generating system according to the invention and a comparative aerosol-generating system not according to the invention.

FIG. 1 shows a schematic illustration of an elongate cartridge 2 according to an embodiment of the invention for use in an aerosol-generating system for generating an aerosol comprising nicotine lactate salt particles.

The cartridge 2 has a length of about 15 millimetres, a width of about 7 millimetres and a height of about 5.2 millimetres. The cartridge 2 comprises an elongate body 4, a distal end cap 6 and a proximal end cap 8.

The body 4 has a length of about 13 millimetres, a width of about 7 millimetres and a height of about 5.2 millimetres. The distal end cap 6 and the proximal end cap 8 have a length of about 2 millimetres, a width of about 7 millimetres and a height of about 5.2 millimetres.

The cartridge 2 comprises an elongate first compartment 10 that extends from the proximal end of the body 4 to the distal end of the body 4. The first compartment 10 contains an alkaloid source comprising a first carrier material 12 impregnated with 18 microlitres of a liquid alkaloid formulation. The liquid alkaloid formulation is a liquid nicotine formulation having a glycerine content of about 32 percent by weight and a nicotine content of about 68 percent by weight.

The cartridge 2 comprises an elongate second compartment 14 that extends from the proximal end of the body 4 to the distal end of the body 4. The second compartment 14 contains a lactic acid source comprising a second carrier material 16 impregnated with about 18 microlitres of lactic acid.

The first compartment 10 and the second compartment 14 are arranged in parallel.

The cartridge 2 further comprises a cavity 18 for receiving a heating element configured to heat the first compartment 10 and the second compartment 14. The cavity 18 is located between the first compartment 10 and the second compartment 14 and extends from the proximal end of the body 4 to the distal end of the body 4. The cavity 18 is of substantially stadium shaped transverse cross-section and has a width of about 6.3 millimetres and a height of about 1 millimetre.

The distal end cap 6 comprises a first air inlet 20 comprising a row of three spaced apart apertures and a second air inlet 22 comprising a row of five spaced apart apertures. Each of the apertures forming the first air inlet 20 and the second air inlet 22 is of substantially circular transverse cross-section and has a diameter of about 0.3 millimetres.

The distal end cap 6 further comprises a third inlet 24 located between the first air inlet 20 and the second air inlet 22. The third inlet 24 is of substantially stadium shaped transverse cross-section and has a width of about 6.3 millimetres and a height of about 1 millimetre.

The proximal end cap 8 comprises a first air outlet 26 comprising a row of three spaced apart apertures and a second air outlet 28 comprising a row of five spaced apart apertures. Each of the apertures forming the first air outlet 26 and the second air outlet 28 is of substantially circular transverse cross-section and has a diameter of about 0.3 millimetres.

As shown in FIG. 1, to form the cartridge 2, the proximal end cap 8 is inserted into the proximal end of the body 4 such that the first air outlet 26 is aligned with the first compartment 10 and the second air outlet 28 is aligned with the second compartment 14.

The first carrier material 12 impregnated with the liquid alkaloid formulation is inserted into the first compartment 10 and the second carrier material 16 impregnated with the lactic acid is inserted into the second compartment 14.

The distal end cap 6 is then inserted into the distal end of the body 4 such that the first air inlet 20 is aligned with the first compartment 10, the second air inlet 22 is aligned with the second compartment 14 and the third inlet 24 is aligned with the cavity 18.

The first compartment 10 and the second compartment 14 are substantially the same shape and size. The first compartment 10 and the second compartment 14 are of substantially rectangular transverse cross-section and have a length of about 11 millimetres, a width of about 4.3 millimetres and a height of about 1 millimetres.

The first carrier material 12 and the second carrier material 16 comprise a non-woven sheet of PET/PBT and are substantially the same shape and size. The shape and size of the first carrier material 12 and the second carrier material 16 is similar to the shape and size of the first compartment 10 and the second compartment 14 of the cartridge 2, respectively.

The first air inlet 20 is in fluid communication with the first air outlet 26 so that a first air stream may pass into the cartridge 2 through the first air inlet 20, through the first compartment 10 and out of the cartridge 2 though the first air outlet 26. The second air inlet 22 is in fluid communication with the second air outlet 28 so that a second air stream may pass into the cartridge 2 through the second air inlet 22, through the second compartment 14 and out of the cartridge 2 though the second air outlet 28.

Prior to first use of the cartridge 2, the first air inlet 20 and the second air inlet 22 may be sealed by a removable peel-off seal or a pierceable seal (not shown) applied to the external face of the distal end cap 6. Similarly, prior to first use of the cartridge 2, the first air outlet 26 and the second air outlet 28 may be sealed by a removable peel-off seal or a pierceable seal (not shown) applied to the external face of the proximal end cap 8.

FIG. 2 shows a schematic illustration of an aerosol-generating system 200 according to an embodiment of the invention for generating an aerosol comprising nicotine lactate salt particles.

The aerosol-generating system comprises an aerosol-generating device 202, a cartridge 2 according to the embodiment of the invention shown in FIG. 1 and a mouthpiece 204.

The aerosol-generating device 202 comprises a housing 206 defining a device cavity 208 configured to receive the cartridge 2 and a heating element (not shown) configured to heat both the first compartment 10 and the second compartment 14 of the cartridge 2.

The heating element is a single elongate electric heating element. The heating element is positioned within the device cavity 208 of the aerosol-generating device 202 and extends along the longitudinal axis of the device cavity 208. The aerosol-generating device 202 further comprises a power supply and a controller (not shown) for controlling a supply of power from the power supply to the heating element.

As the cartridge 2 is inserted into the device cavity 208 of the aerosol-generating device 202, the heating element passes through the third inlet 24 of the distal end cap 106 of the cartridge 2 and is received in the cavity 18 located between the first compartment 10 and the second compartment 14 of the cartridge 2. During use, the controller of the aerosol-generating device 202 controls the supply of power from the power supply aerosol-generating device 202 to the heating element to heat the first compartment 10 and the second compartment 14 of the cartridge 2 to substantially the same temperature of about 115° C.

Once the cartridge 2 has been inserted into the device cavity 208 of the aerosol-generating device 202, the distal end of the mouthpiece 204 is connected to the proximal end of the housing 206 of the aerosol-generating device 202.

In use, a user draws on the proximal end of the mouthpiece 204 to draw a first air stream through the first compartment 10 of the cartridge 2 and a second air stream through the second compartment 14 of the cartridge 2. As the first air stream is drawn through the first compartment 10 of the cartridge 2, nicotine and glycerine vapour is released from the first carrier material 12 into the first air stream. As the second air stream is drawn through the second compartment 14 of the cartridge 2, lactic acid vapour is released from the second carrier material 16 into the second air stream.

The nicotine vapour in the first air stream and the lactic acid vapour in the second air stream react with one another in the gas phase in the mouthpiece 204 to form an aerosol of nicotine lactate salt particles, which is delivered to the user through the proximal end of the mouthpiece 204. As described above, the sensorial harshness of the aerosol is perceived to be lower by the user due to the presence of the glycerine within the aerosol.

In an alternative embodiment (not shown), the distal end of the mouthpiece 204 may be configured for engagement with the proximal end of the cartridge 2 rather than the proximal end of the housing 206 of the aerosol-generating device 202.

In the aerosol-generating system according to invention shown in FIG. 2, the aerosol-generating device 202 comprises a heating element within the device cavity 208 and the cartridge 2 comprises a cavity 18 for receiving the heating element. In an alternative embodiment (not shown), rather than a cavity for receiving a heating element configured to heat the first compartment and the second compartment, the cartridge may comprise a heating element located between the first compartment and the second compartment. In this alternative embodiment, the aerosol-generating device may be configured to supply power to the heating element of the cartridge by means of one or more connection points of the heating element at the distal end of the cartridge.

In the aerosol-generating system according to invention shown in FIG. 2, the aerosol-generating device 202 comprises an electric heating element within the device cavity 208 and the cartridge 2 comprises a cavity 18 for receiving the heating element. In an alternative embodiment (not shown), the aerosol-generating device 202 may comprise an inductive heating element circumscribing the device cavity 208 and the cartridge 2 may comprise a susceptor positioned within the cavity 18. In this alternative embodiment, during use the controller of the aerosol-generating device 202 controls the supply of power from the power supply of the aerosol-generating device 202 to the inductive heating element to heat the susceptor within the cavity 18 of the cartridge 2. Once heated, the susceptor heats the first compartment 10 and the second compartment 14 of the cartridge 2.

EXAMPLE

FIGS. 3A-C show the: percentage by volume of droplets having a particle size below 5 microns (FIG. 3A); transmittance (FIG. 3B) and; average amount of alkaloid (nicotine) delivered per puff for aerosols generated by an aerosol-generating system according to the invention and a comparative aerosol-generating system not according to the invention.

The aerosol-generating system according to the invention comprises a cartridge according to the invention comprising: a first compartment containing an alkaloid source, the alkaloid source comprising a first carrier material impregnated with 18 microlitres of a liquid nicotine formulation comprising 5 microlitres (6.3 milligrams) of glycerine and 13 microlitres (13.13 milligrams) of nicotine; and a second compartment containing an acid source, the acid source comprising a second carrier material impregnated with 18 microlitres of lactic acid.

The comparative aerosol-generating system according to the invention comprises a cartridge not according to the invention comprising: a first compartment containing an alkaloid source, the alkaloid source comprising a first carrier material impregnated with 13 microlitres (13.13 milligrams) of nicotine; and a second compartment containing an acid source, the acid source comprising a second carrier material impregnated with 18 microlitres of lactic acid.

All features of the aerosol-generating system according to the invention and the comparative aerosol-generating system according to the invention are identical except for the liquid nicotine formulation of the alkaloid source.

The aerosols generated by the aerosol-generating systems under a Health Canada smoking regime (12 puffs of 2 seconds each with a puff volume of 55 millilitres and a puff interval of 30 seconds) are collected and the percentage by volume of droplets having a particle size below 5 microns (FIG. 3A), transmittance (FIG. 3B) and average amount of alkaloid (nicotine) delivered per puff measured using standard techniques. During the tests, the cartridges of the aerosol-generating systems are heated by a heating element controlled to provide a steady state temperature of 115° C.

A pre-heating period of 1 minute is carried out prior to commencement of the puffs to enable the steady state temperature to be reached.

The results shown in FIGS. 3A-C are the average of 4 tests. In FIGS. 3A-3C, the results for the aerosol-generating system according to the invention are shown by the left-hand bars and the results for the comparative aerosol-generating system not according to the invention are shown by the right-hand bars.

The perceived sensorial harshness of the aerosol generated by the aerosol-generating system according to the invention and the aerosol generated by the aerosol-generating system not according to the invention is also assessed.

The sensorial harshness of the aerosol generated by the aerosol-generating system according to the invention is advantageously perceived to be lower than that of the aerosol generated by the aerosol-generating system not according to the invention.

As shown in FIGS. 3A and 3B, the percentage by volume of droplets having a particle size below 5 microns (FIG. 3A) and transmittance, which is a measure of the total number of droplets per puff, (FIG. 3B) of the aerosol generated by the aerosol-generating system according to the invention are the same as those of the aerosol generated by the aerosol-generating system not according to the invention.

As shown in FIG. 3C, the nicotine delivery per puff for the aerosol generated by the aerosol-generating system according to the invention is advantageously higher than that of the aerosol generated by the aerosol-generating system not according to the invention.

The invention claimed is:

1. A cartridge for an aerosol-generating system, the cartridge comprising:

a first compartment containing an alkaloid source, the alkaloid source comprising a liquid alkaloid formulation having a polyhydric alcohol content of at least about 10 percent by weight and an alkaloid content of at least about 10 percent by weight; and a second compartment containing an acid source.

2. The cartridge according to claim 1, wherein the weight percent alkaloid content of the liquid alkaloid formulation is at least about 1.5 times the weight percent polyhydric alcohol content of the liquid alkaloid formulation.

3. The cartridge according to claim 1, wherein the weight percent alkaloid content of the liquid alkaloid formulation is less than or equal to about 8 times the weight percent polyhydric alcohol content of the liquid alkaloid formulation.

4. The cartridge according to claim 1, wherein the weight percent alkaloid content of the liquid alkaloid formulation is between about 2 times and about 4 times the weight percent polyhydric alcohol content of the liquid alkaloid formulation.

5. The cartridge according to claim 1, wherein the alkaloid content of the liquid alkaloid formulation is at least about 70 percent by weight.

6. The cartridge according to claim 1, wherein the polyhydric alcohol content of the liquid alkaloid formulation is between about 10 percent by weight and about 30 percent by weight.

7. The cartridge according to claim 1, wherein the liquid alkaloid formulation comprises one or more flavourants.

8. The cartridge according to claim 1, wherein the alkaloid is nicotine.

9. The cartridge according to claim 1, wherein the polyhydric alcohol is glycerine.

10. The cartridge according to claim 1, wherein the acid source comprises lactic acid.

11. The cartridge according to claim 1, wherein the alkaloid source further comprises a first carrier material impregnated with the liquid alkaloid formulation.

12. The cartridge according to claim 11, wherein the first carrier material is impregnated with between about 10 microlitres and about 25 microlitres of the liquid alkaloid formulation.

13. The cartridge according to claim 1, wherein the acid source comprises a second carrier material impregnated with acid.

14. The cartridge according to claim 13, wherein the second carrier material is impregnated with between about 10 microlitres and about 25 microlitres of acid.

15. An aerosol-generating system, comprising:

a cartridge according to claim 1; and an aerosol-generating device comprising:

a housing defining a device cavity configured to receive at least a portion of the cartridge, and a heating element configured to heat the first compartment and the second compartment of the cartridge.

* * * * *